United States Patent [19]

Whiting

[11] Patent Number: 4,579,035

[45] Date of Patent: Apr. 1, 1986

[54] INTEGRATED WEAPON CONTROL SYSTEM

[75] Inventor: Ian G. Whiting, Borne, Netherlands

[73] Assignee: Hollandse Signaalapparaten B.V., New York, N.Y.

[21] Appl. No.: 558,656

[22] Filed: Dec. 6, 1983

[30] Foreign Application Priority Data

Dec. 6, 1982 [NL] Netherlands ..... 8204706

[51] Int. Cl.[4] ..... F41G 3/06; G06F 15/58

[52] U.S. Cl. ..... 89/41.05; 89/41.06; 89/41.07; 89/41.17

[58] Field of Search ..... 89/41.17, 41.05, 41.06, 89/41.07

[56] References Cited

U.S. PATENT DOCUMENTS

| | | | |
|---|---|---|---|
| 2,743,439 | 4/1956 | Crump | 89/41.07 X |
| 2,968,997 | 1/1961 | Newton, Jr. | 89/41.02 |
| 3,019,711 | 2/1962 | Bailey et al. | 89/41.07 X |
| 3,144,644 | 8/1964 | Getting | 89/6 X |
| 3,602,088 | 8/1971 | Spring | 89/41.07 X |
| 3,766,826 | 10/1973 | Salomonsson | 89/41.17 |
| 3,798,795 | 3/1974 | Michelson | 89/41.05 X |
| 3,946,640 | 3/1976 | Baumann | 89/41.07 X |
| 4,004,729 | 1/1977 | Rawicz et al. | 89/41.07 X |
| 4,020,407 | 4/1977 | Clement et al. | 89/41.17 X |

FOREIGN PATENT DOCUMENTS

| | | |
|---|---|---|
| 657669 | 9/1951 | United Kingdom . |
| 1108072 | 4/1968 | United Kingdom . |

*Primary Examiner*—David H. Brown
*Attorney, Agent, or Firm*—Robert J. Kraus

[57] ABSTRACT

Integrated weapon control system including target search and tracking means, whereby the turret is rotatable about an axis perpendicular to a first reference plane and whereby the gun is slewable about an axis parallel to this first reference plane. The target search means are fitted triaxially on the turret and stabilized biaxially with respect to a second reference plane, wherewith the target tracking means are mounted multi-axially on the gun.

2 Claims, 2 Drawing Figures

INTEGRATED WEAPON CONTROL SYSTEM

The invention relates to an integrated weapon control system including target search and tracking means, whereby the turret is rotatable about an axis perpendicular to a first reference plane and whereby the gun is slewable about an axis parallel to this reference plane.

BACKGROUND OF THE INVENTION

Various embodiments of such a type of integrated weapon control system are known, each characterised by a separate arrangement of the target search and tracking means with respect to the turret and gun. If the first reference plane is the deck plane of a ship as the foundation plane of the turret, the above arrangement has disadvantage that the turret and gun position relative to the target search and tracking means, as measured in the earth-fixed coordinate system, is constantly subject to variation in consequence of ship deformation and alignment errors, which are continuously changing.

Through this problem the usability of an integrated weapon control system of the type set forth in the opening paragraph is very limited, especially in circumstances of engaging fast moving targets of a small effective area; this must be regarded as a disadvantage of the above weapon control system.

SUMMARY OF THE INVENTION

The present invention has for its object to provide an integrated weapon control system of the type set forth in the opening paragraph, whereby the above disadvantages are obviated to a high extent, and whereby the usability of the system is greatly increased in the above-mentioned circumstances.

An advantageous and favourable embodiment of an integrated weapon control system of the type set forth in the opening paragraph is obtained when, according to the invention, the target search means of such a weapon control system are fitted triaxially on the turret and stabilised biaxially with respect to a second reference plane, wherewith in combination the target tracking means are mounted multiaxially on the gun.

The weapon control system according to the invention also offers the possibility to incorporate the whole system into a complete autonomous unit, constructionally and operationally; this is of particular importance to replacing quickly a defective weapon control system and obtaining a fully independently operating unit.

The invention will now be described in more detail with reference to the accompanying figures, illustrating a feasible embodiment of an integrated weapon control system according to the invention.

DESCRIPTION OF THE PREFERRED EMBODIMENT

Figures 1, 2:
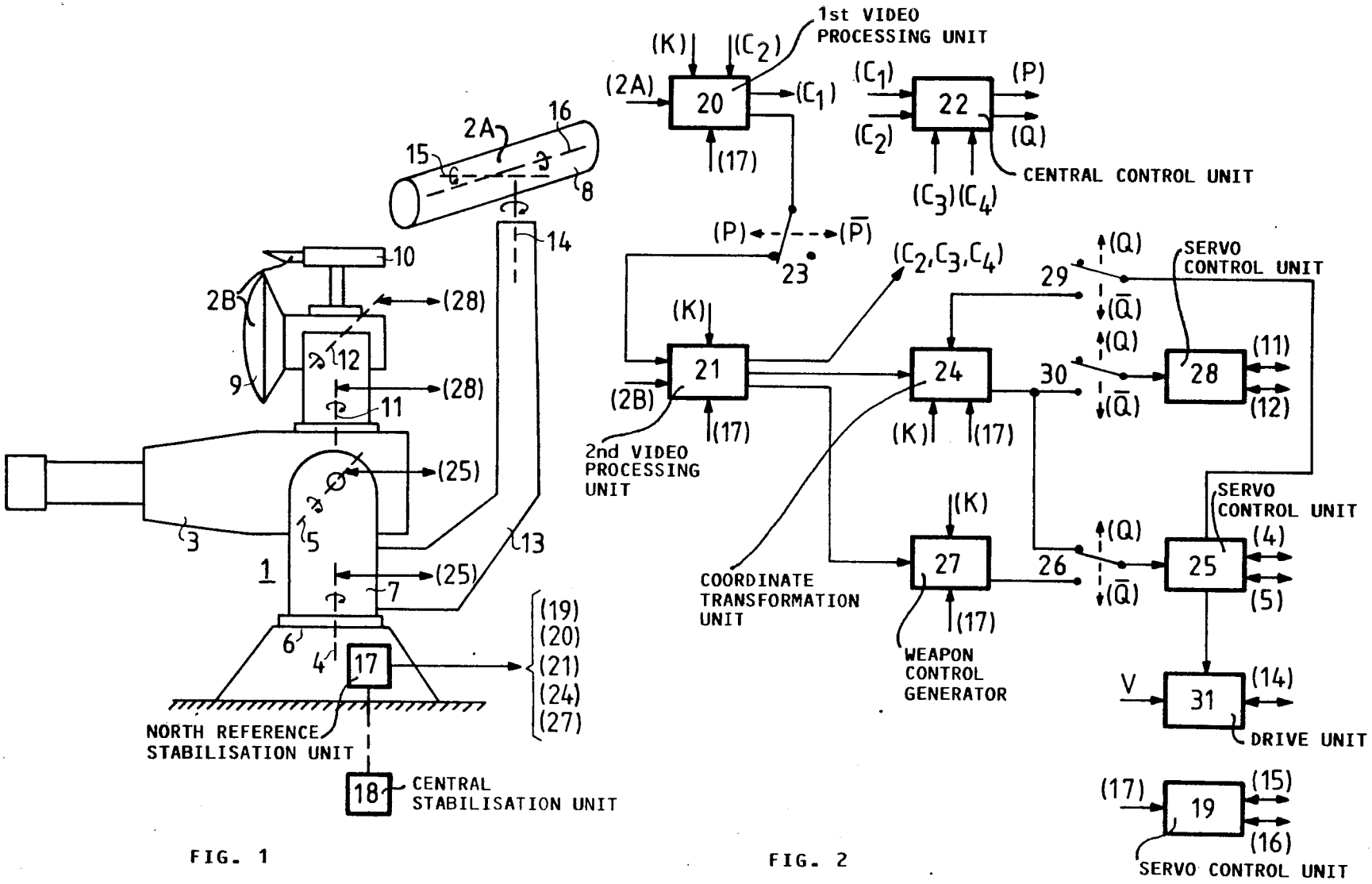
FIG. 1 shows a schematic diagram of a weapon assembly.
FIG. 2 shows in block form a signal processing arrangement.

In FIG. 1*a* weapon assembly 1, is fitted with target search and tracking means 2A and 2B, respectively. The gun 3 of assembly 1 is slewable about two mutually perpendicular axes 4 and 5, where axis 4 is perpendicular to a first reference plane 6 and axis 5 parallel to plane 6 in the turret 7 of weapon assembly 1. With a weapon arrangement on board a ship the first reference plane 6 is formed by the platform of the on-deck turret base, so that axis 4 permits a slewing motion of gun 3 in azimuth and axis 5 a slewing motion in elevation to a given aiming angle.

The target search and tracking means 2A and 2B may be of different composition. For a radar design, the target search means 2A may consist of a search radar with a search antenna 8, and the target tracking means 2B of a tracking radar with a tracking antenna 9, whereas for an optical design these means may comprise an infrared detector or a TV unit, each provided with a laser range finder 10. It is also possible to employ a combination of both optical and radar means in obtaining the target search and tracking means 2A and 2B.

In the illustrated embodiment of a weapon control system, the target tracking means 2B are mounted on the gun 3 and are able to slew about two mutually perpendicular axes 11 and 12, of which axis 11 is perpendicular to the plane passing through axis 5 and the bore axis of gun 3, and axis 12 perpendicular to the plane passing through axis 11 and the bore axis of gun 3. In addition to this biaxial arrangement, a quadraxial disposition of the target tracking means 2B is possible.

The target search means 2A, on the other hand, are mounted on a column 13 connected with the turret 7 and have to perform a search motion in a second, fixed reference plane, usually a reference plane coupled to the earth or sea surface and located at the weapon control system. If the target search means 2A consist of a search radar and an antenna 8, the antenna 8 is triaxial, i.e. it is mounted on the turret movable about three axes 14, 15 and 16. Axis 14 represents a rotation axis parallel to axis 4, permitting a search motion with antenna 8. Axis 15 is supported by the rotation axis 14 and is perpendicularly disposed thereon. This allows the search antenna 8 to direct itself parallel to the earth or sea surface or second reference plane. Axis 16 is supported by axis 15 and is perpendicularly disposed thereon, permitting the search antenna 8 to perform a limited slewing motion in elevation to scan the earth or sea surface and the air space to a certain elevation jointly with the radar beam. Axes 15 and 16 are indispensable for the required stabilisation of antenna 8 for level and cross-level angles of the deck plane with respect to the earth or sea surface in consequence of the roll and pitch motions of the vessel. The three-axis arrangement of the radar search antenna 8 is known from the standard work of W. M. Cady, M. B. Karelitz and L. A. Turner: "Radar Scanners and Radomes", MIT Radiation Laboratory Series, Vol. 26, McGraw-Hill Book Co., New York. The required stabilization is obtainable with a single, north-referenced stabilization unit 17, mounted on the base of turret 7 and used to determine the compass angle, the level angle and the cross-level angle. Instead of the above stabilization with a single reference platform, stabilization of the turret search means 2A is possible by means of a central stabilization unit 18, usually mounted at the ship's centre to produce coarse data on the level and cross-level angles of the deck plane at the location of unit 18, as well as definite data on the compass direction. Supplementary to the coarse data, unit 17 on the turret 7, as a local stabilization unit, provides more accurate data on the level and cross level angles still prevailing on account of the elastic deformation effect between turret 7 and the ship's parts at the location of the central stabilization unit 18. The error voltages of unit 17 (and unit 18 if applicable) concerning the level and cross-level angles are supplied to a servo control unit 19 to permit an elevation search motion of antenna 8 about axes 15 and 16.

The detected target signals are processed in the receiver of target search means 2A to form video signals. These video signals contain information about azimuth ($\phi$), range (r) and speed (v) and, if applicable, coarse information about the angle of sight ($\epsilon$) of the detected targets. As illustrated in FIG. 2, further processing of these video signals is performed in a first video processing unit 20 connected to means 2A; in video processing unit 20 the applied video signals are transformed to a coordinate system coupled to the earth or sea surface, using the data processed by the compass ($\kappa$) and stabilization unit 17, and subjected to a number of successive processing steps. These steps concern among others:

- the video extraction to obtain a sample of the supplied amount of video signals;
- the plot processing to produce video clusters from the sampled video signals;
- the correlation and association of the video clusters obtained in successive antenna revolutions;
- the generation of the target tracks on account of the correlation and association results obtained;
- the threat evaluation to list the targets considered in order of priority with respect to position, track motion, speed, and type of the detected targets; and finally, on the ground thereof,
- target selection for the purpose of the acquisition and tracking phase then initiated by the target tracking means 2B.

As soon as the track generation of the selected target yields a reliable result, the weapon control system can enter the acquisition phase (A) to activate the tracking means 2B and a second video processing unit 21, connected thereto. The transformation to the acquisition phase (A) is provided by a central control unit 22, which thereto receives a signal $C_1$ from the first video processing unit 20. In response to this signal, the control unit 22 produces a first switching signal (P) for application to a switching unit 23 to make the connection between the first and the second video processing units 20 and 21. This enables a continuous supply of recent data about the position (range r and azimuth $\phi$) of the selected target. With the continuously updated range and azimuth values the target tracking means 2B perform an elevation search scan.

Although the azimuth ($\phi$) is established in a coordinate system coupled to the earth or sea surface, the elevation search scan of tracking means 2B must be performed in the coordinate system coupled to the deck plane and oriented to the course line. To this effect, the second video processing unit 21 constantly supplies the latest azimuth value together with a monotonically increasing angle of sight to a coordinate transformation unit 24. From the data supplied by the compass ($\kappa$) and the stabilization unit 17, concerning the ship's course, roll, pitch and yaw, the coordinate transformation unit 24 establishes the associated training angle $B_{m'2}$ and elevation $E_{m'2}$.

Since in the acquisition phase (A) the tracking means 2B on gun 3 are stopped, a servo control unit 25 mounted on the weapon assembly 1 provides for the required angular motion of gun 3 and tracking means 2B about axes 4 and 5. For this purpose a switching unit 26 is incorporated in the connection between transformation unit 24 and servo control unit 25; in the acquisition phase the switching unit 26 is in the position as shown in the figure. Switching unit 26 is operated by a second switching signal Q generated by the central control unit 22.

When a target is detected, the second video processing unit 21 supplies the central control unit 22 with a control signal $C_2$ to stop the generation of the first switching signal ($\overline{P}$). The second switching signal (Q) is however maintained. The weapon control system then enters the tracking phase (T) and, from the angular errors $f(B_{m'2})$ and $f(E_{m'2})$ measured with tracking means 2B, the second video processing unit 21 determines a new target position for the servo control unit 25 to obtain a correct tracking with gun 3 and the target tracking means 2B. On the basis of the present training $B_{m'2}$ and present elevation $E_{m'2}$ angles corrected for the angular errors, the position and the trajectory of the target will be kept updated by the second video processing unit 21 after a coordinate transformation to the coordinate system coupled to the earth or sea surface and, on the ground of the supplied data about the target trajectory, a time-realiable determination of the aiming point will be performed by a weapon control generator 27 connected to processing unit 21. After the weapon control generator 27 has provided the necessary corrections, as to wind velocity, barometric pressure, type of ammunition etc., and after a coordinate transformation, this aiming point results in the point of sight of the gun with angular values $B_{r'2}$ and $E_{r'2}$ referenced to the deck plane.

Once the target being tracked is within gun range, the second video processing unit 21 supplies the central control unit 22 with a control signal $C_3$ to indicate the initiation of the gun aiming phase (D). The supply of control signal $C_3$ to the central control unit 22 discontinues the generation of the second control signal $\overline{Q}$, causing the switching unit 26 to assume the position other than shown in the figure. Consequently, the $B_{r'2}$ and $E_{r'2}$ values of the weapon control generator 27 are supplied to the servo control unit 25 to drive the gun about axes 4 and 5.

Due to the own motion of the weapon assembly 1 during the aiming phase (D), the tracking means 2B on the gun 3 can no longer be held in the arrested state to continue tracking of the target, but will independently perform a motion about axes 11 and 12, making use of their own servo control unit 28. This motion must be performed with respect to the weapon assembly 1; to this effect the coordinate transformation unit 24 determines the difference angles $B_{m'2}-B_{r'2}$ and $E_{m'2}-E_{r'2}$. The desired transfer of data about the gun aiming coordinates to the coordinate transformation unit 24 by servo control unit 25 is performed via a switching unit 29, but only during the off time of the second control signal ($\overline{Q}$).

The output values of the coordinate transformation unit 24 must be put at the disposal of servo control unit 28 of tracking means 2B during the aiming phase (D). To make the required connection between units 24 and 28, a switching unit 30 is incorporated, permitting the data transfer from coordinate transformation unit 24 to servo control unit 28 during the off time of the second switching signal ($\overline{Q}$). After a certain duration following on the initiation of the aiming phase (D), the gun will be brought into operation.

Also during the aiming phase (D) the target search means 2A and the first video processing unit 20, connected thereto, remain operational. Consequently, after engagement of the tracked target directly on the ground of a threat evaluation made by unit 20 in the meantime, the tracking data of a subsequent target can be handed over to the second video processing unit 21 for a following acquisition, tracking and aiming phase.

With the transition from the acquisition phase (A) to the tracking phase (T) the selected target is scrapped from the prior list, made on account of a threat evaluation. The remaining targets thus shift one position up in this list; this occurs on the supply of control signal $C_2$ to the first video processing unit 20. It must be prevented that directly thereafter, i.e. during the time the target acquisition, tracking or aiming phase is still in progress, the data from the subsequent target are handed over. Hence, only when the target has been engaged successfully (this can be ascertained from the signal-to-noise ratio or visually) or the target has gone beyond the tracking range, or the tracking means 2B is still to enter the operational mode, the second video processing unit 21 will supply the central control unit 22 with a control signal $C_4$. The first switching signal (P) will not be generated until the presence of the control signal $C_4$.

With the performance of a slewing motion by gun 3 in training, this motion will be superimposed on that of the search means 2A, unless appropriate measures are taken against it. Prior to this, it is possible to update the rate of change ($\Delta B_{r2}$) of the sight training of weapon assembly 1 in servo control unit 25; unit 25 is used to generate an error voltage for the drive unit 31 of target search means 2A to obtain a modified rotation of these means about axis 14. The correction on the rotation of target search means 2A may also be omitted, but due allowance must be made for the variation in the angular velocity of the search antenna with the processing of the video signals.

The operation of the weapon control system described above is fully automatic. It is also possible, however, to manually execute one or several step changes in the system. For example, the data produced by the first video processing unit 20 can be presented on a display and interpreted visually. After target selection, the data concerned can be transferred to the second video processing unit 21 by manual operation of switch 23. Also the switching signal $C_4$ is manually obtainable on account of observations (directly through optical tracking means or indirectly through a display).

I claim:

1. Integrated weapon control system comprising:

a turret rotatable about an axis perpendicular to a first reference plane;

a gun disposed on said turret and slewable about an axis parallel to said first reference plane;

a target search means mounted triaxially on said turret for performing a search motion in a second fixed reference plane, wherein said target search means is stabilized biaxially with respect to said second reference plane; and a target tracking means mounted on said gun, for multiaxial movement with respect to said first reference plane.

2. Integrated weapon control system as claimed in claim 1, further comprising a video processing unit connected to said target tracking means to produce angular error voltages, a first servo control unit for driving the target tracking means, a second servo control unit for providing gun aiming data, and a coordinate transformation unit connected to an output of said video unit, an input of said first servo control unit and to said second servo control unit for providing angular error voltages to be applied to said first servo control unit modified by gun aiming data supplied by said second servo control unit.

* * * * *